US008857782B2

(12) United States Patent
Xammar Bove

(10) Patent No.: US 8,857,782 B2
(45) Date of Patent: Oct. 14, 2014

(54) FLOOR SLAB FORMWORK WITH LONGITUDINALLY ADJUSTABLE SUPPORTING GIRDER

(75) Inventor: Pedro Xammar Bove, Barcelona (ES)

(73) Assignee: Inveral, S.A., Barcelona (ES)

( * ) Notice: Subject to any disclaimer, the term of this patent is extended or adjusted under 35 U.S.C. 154(b) by 520 days.

(21) Appl. No.: 13/120,729

(22) PCT Filed: Sep. 22, 2009

(86) PCT No.: PCT/EP2009/062243

§ 371 (c)(1), (2), (4) Date: Mar. 24, 2011

(87) PCT Pub. No.: WO2010/037666

PCT Pub. Date: Apr. 8, 2010

(65) Prior Publication Data

US 2011/0168868 A1 Jul. 14, 2011

(30) Foreign Application Priority Data

Oct. 1, 2008 (ES) ..... 200802780

(51) Int. Cl.

| | |
|---|---|
| ***E04G 11/38*** | (2006.01) |
| ***E04G 11/54*** | (2006.01) |
| ***E04G 11/50*** | (2006.01) |
| ***E04G 11/52*** | (2006.01) |
| *E04C 3/04* | (2006.01) |
| *E04C 3/09* | (2006.01) |

(52) U.S. Cl.

CPC ..... *E04G 11/50* (2013.01); *E04G 11/52* (2013.01); *E04C 3/09* (2013.01); *E04G 11/54* (2013.01); *E04G 11/38* (2013.01)

USPC ..... 249/19; 52/668; 52/669; 52/854

(58) Field of Classification Search

CPC ..... E04G 9/00; E04G 11/00; E04G 11/36; E04G 11/38; E04G 11/48; E04G 11/50; E04G 11/52; E04G 11/54; E04G 2011/36; E04G 2011/48; E04G 201/50; E04C 3/09; E04C 3/28; E04C 3/29

USPC ..... 52/854, 664, 666, 669, 668; 248/235, 248/250; 211/90.02, 103, 187, 208, 190, 211/191; 108/27; 312/348.2; 249/13, 18, 19

See application file for complete search history.

(56) References Cited

U.S. PATENT DOCUMENTS 6,896,142 B2 * 5/2005 Kaltz et al. ..... 206/585

FOREIGN PATENT DOCUMENTS

| | | | |
|---|---|---|---|
| DE | 196 36 091 | A1 | 3/1998 |
| DE | 199 32 707 | C1 | 2/2001 |
| ES | 2 244 282 | A1 | 12/2005 |
| ES | 2 253 084 | A1 | 5/2006 |
| ES | 2 310 956 | A1 | 1/2009 |

* cited by examiner

*Primary Examiner* — Michael Safavi

(74) *Attorney, Agent, or Firm* — Sughrue Mion, PLLC

(57) ABSTRACT

A formwork system comprising a supporting girder for the support girders that receives the support of floor slab formwork boards. The upper face of the supporting girder is provided with a plurality of successive housings for receiving the girders, arranged one after another forming a series of housings along the entire length of the upper face without interruption, such that the girders can be transversely arranged and, where appropriate, overlapped with one another for their extension, in any position along the supporting girder. The housings can have identical transverse dimensions, therefore the supporting girders can also be overlapped with one another to extend their length.

3 Claims, 5 Drawing Sheets

FLOOR SLAB FORMWORK WITH LONGITUDINALLY ADJUSTABLE SUPPORTING GIRDER

CROSS REFERENCE TO RELATED APPLICATIONS

This application is a National Stage of International Application No. PCT/EP2009/062243 filed Sep. 22, 2009, claiming priority based on Spanish Patent Application No. 200802780 filed Oct. 1, 2008, the contents of all of which are incorporated herein by reference in their entirety.

TECHNICAL FIELD OF THE INVENTION

The present invention relates to a supporting girder, of those usually used in formwork systems for two-way floor slabs with main beams in both directions or flat floor slabs and to the formwork system comprising said supporting girder. In said systems, the supporting girders receive along their length the support of several girders which are transversely arranged and which in turn support the formwork boards that make up the formwork surface of the floor slab to be concreted.

BACKGROUND OF THE INVENTION

Props, supporting girders and boards forming the formwork surface of the floor slab are basically involved in two-way floor slab or flat floor slab typologies, which are extensively used in Spain. In the assembly of the formwork, several alignments of supporting girders arranged parallel to one another and supported on props and additionally on the side faces of some of the already concreted pillars are first placed. Then, the girders are placed in a direction perpendicular to the alignments of the supporting girders, fitting and being supported in the housings of the upper face of the supporting girders which are separated from one another by a fixed inter-axis distance. Finally, the boards are placed, supporting them on the mentioned girders.

These meccano systems are generally suitable for the formwork of open spaces, in which the formwork may remain in a cantilever way. In contrast, when the floor slab formwork is surrounded by walls, it is very complicated to adjust the girders and the supporting girders against said walls, the meccano assembly falling too short, which generally forces finishing the formwork with wooden planks, going against the industrialization of the meccano system, the formwork process becoming a slow and laborious task.

Spanish patent ES2244282 solves the aforementioned problem by providing a supporting girder having spaces for fitting girders in multiple groups of adjacent and identical housings, particularly groups of three, distributed along the upper face of the supporting girders. Said arrangement makes it possible, upon reaching an area having an opening with a length smaller than that of a girder, to arrange, next to each of the girders placed until that time, which are supported at their ends on the supporting girders, another new girder housed in one of the housings adjacent to the already placed girders. The new girder which will cover the opening can thus run through the mentioned housing of the same group in order to achieve the sufficient and suitable free length for covering the remaining opening. The useful length of the new girder may be adjusted to the one needed in each case, since the supporting girder lacks longitudinal stops.

Furthermore, the longitudinal extension of the supporting girders has also been provided since they are provided, close to one of their ends, with a lower flange having a hole, on each side of the supporting girder, suitable for receiving the lower centering rod of another supporting girder which will be used as an extension of the previous one. The overlap length between supporting girders is obviously conditioned by the alignment which there must be between the housings of both elements.

Despite the fact that the supporting girder described above has considerable advantages in terms of the extension of the girders for covering the surface to be formed, while carrying out a construction work it is usual that reconsiderations happen and therefore, the position and/or dimensions of elements such as stairwells, elevator shafts, conduit passage gaps, etc. have to be changed, having to resort again to improvised solutions since neither the number nor the position of the girders fitted in the corresponding housings of the supporting girders can be changed.

Furthermore, the fixed position occupied by the groups of three housings restricts the possibilities of extension by the overlapping the supporting girders since the transverse alignment between said groups has to be ensured for such purpose, which forces providing the supporting girder with at least one lower centering rod and with a lower flange provided with a hole on each side of the supporting girder for receiving the rod of another supporting girder. For example, if the supporting girders have five groups of three housings distributed equidistantly to one another, they are provided with a sole lower flange arranged under the central housing of a group of three located at one of the ends of the supporting girder, and with a single centering rod arranged under the central housing of the group located at the middle of the length of the supporting girder, a supporting girder can only be extended a distance equivalent to half its length since when the centering rod of a supporting girder is inserted in the hole of the flange of another one, the overlap length will be half the length of a supporting girder.

Therefore, the need to have a more versatile supporting girder with which the whole surface to be formed can be covered, which can easily be adapted to several types of boards, and to the requirements of loads and deflections of the floor slabs depending on which a larger or smaller number of supporting girder is placed.

DISCLOSURE OF THE INVENTION

For the purpose of providing a solution to the problems considered, a formwork system for two-way floor slabs with main beams in both directions or for flat floor slabs is disclosed.

For the purpose of providing a solution to the problems considered, a formwork system for two-way floor slabs with main beams in both directions or for flat floor slabs is disclosed.

The formwork system according to the invention for two-way floor slabs with main beams in both directions or for flat floor slabs comprises a plurality of formwork boards defining the formwork surface of the floor slab to be concreted, a plurality of girders, each one adapted to receive along its length the support of at least one formwork board transversely arranged on the upper face of the girder, and a plurality of supporting girders, each one adapted to receive along its length the support of at least two girders transversely arranged on the upper face of the supporting girder, all of said components of the system arranged in such a way that at least one end of each girder extends beyond its support on the upper face of a supporting girder, crossing the width of said supporting girder.

The formwork system according to the invention is essentially characterized in that the upper face of each supporting girder is provided with a plurality of successive housings for receiving the girders, said housings being arranged one after another forming a series of housings along the entire length of said upper face without interruption, such that the girders can be placed transversely and, where appropriate, overlapped with one another for their extension, in any position along the supporting girder.

According to another feature of the invention, the housings of the supporting girders have identical transverse dimensions, which allows the extension of the supporting girder by overlapping it with another one and, at the same time, the regulation of the length of said extension.

With regard to another feature of the invention, the plurality of successive housings of each supporting girder is formed by a succession of projections provided on the upper edge of the supporting girder, such that the housings are defined by the space between two contiguous projections, and each projection extends from the upper edge of a lateral face of the supporting girder to the upper edge of the opposite lateral face of the supporting girder.

According to a particular embodiment of the invention, the plurality of successive housings of the supporting girders is formed by a continuous strip provided with a succession of projections, such that the housings are defined by the space between two contiguous projections, said strip being applied on the upper face of the supporting girder.

With regard to another embodiment of the invention, the upper face of each supporting girder is provided with a succession of projections, said projections being removably couplable to the surface of the upper face of the supporting girder, such that the space between two contiguous projections defines a housing. Additionally, the surface of the upper face of each supporting girder is provided with a succession of holes and in that the projections are provided at their lower part with a coupling pin intended to fit inside said holes.

According to another feature of the invention, the girders are made of wood and the transverse dimension of the housings of the supporting girders is comprised between 81.5 and 83.5 mm.

According to a second aspect of the invention, a supporting girder of those receiving the support of girders for supporting floor slab formwork boards is disclosed.

The supporting girder object of the invention is essentially characterized in that its upper face is provided with a plurality of successive housings for receiving the girders, arranged one after another forming a series of housings along the entire length of said upper face without interruption, such that the girders can be transversely arranged and, where appropriate, overlapped with one another for their extension, in any position along the supporting girder.

According to another feature of the invention, the housings have identical transverse dimensions, which allows extending the supporting girder by overlapping it with another one and, at the same time, regulating the length of said extension. To overlap a supporting girder with another one, it is enough to place next to the supporting girder to be extended another supporting girder such that the extension length (for example, the distance between the free end of the first supporting girder and a wall) projects from the first supporting girder. Subsequently, the overlap length must be only slightly adjusted so that the housings of both supporting girders are transversely aligned, which does not involve any difficulty since the housings have the same dimensions and are located one after another. A very precise regulation is thus achieved since the extended distance will always be a multiple of the transverse dimension of a housing, equivalent to the width of a girder, and it is not necessary to provide the supporting girder with centering rods or flanges provided with a hole for the overlapping of said supporting girders.

According to another feature of the invention, the plurality of successive housings is formed by a continuous strip provided with a succession of projections, such that the housings are defined by the space between two contiguous projections, said strip being applied on the upper face of the supporting girder.

According to another feature of the invention, the upper face of the supporting girder is provided with a succession of projections, said projections being removably couplable to the surface of the upper face of the supporting girder, such that the space between two contiguous projections defines a housing.

According to another feature of the invention, the surface of the upper face of the supporting girder is provided with a succession of holes and the projections are provided at their lower part with a coupling pin intended to fit inside said holes.

The transverse dimension of the housings is preferably comprised between 81.5 and 83.5 mm. The configuration of the housings according to this range of measurements prevents the overturn of the housed girders, especially when they are wooden girders, generally HT-20 beams.

BRIEF DESCRIPTION OF THE DRAWINGS

The attached drawings show, by way of a non-limiting example, several preferred embodiments of the supporting girder object of the invention. In said drawings.

DETAILED DESCRIPTION OF THE DRAWINGS

Figure 1:
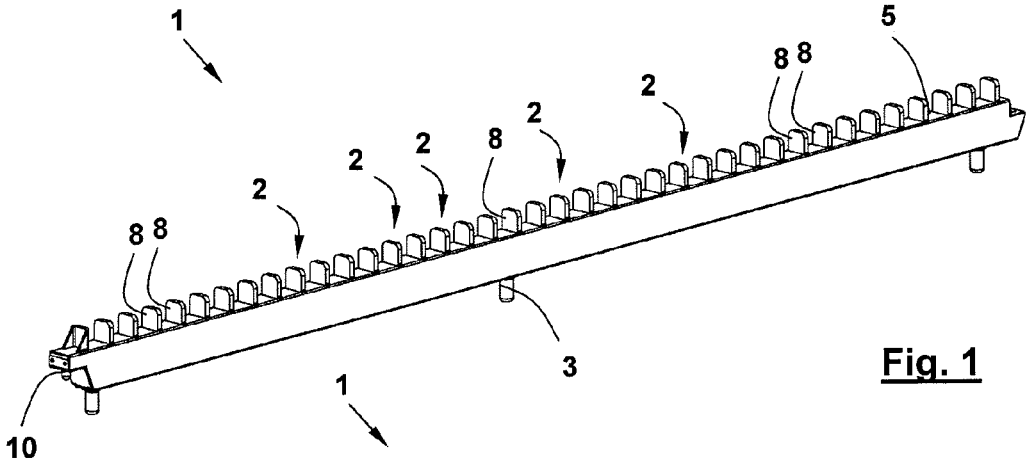
FIG. 1 and FIG. 2 are perspective and elevational views, respectively, of a first embodiment of the supporting girder according to the invention.
Figure 3:
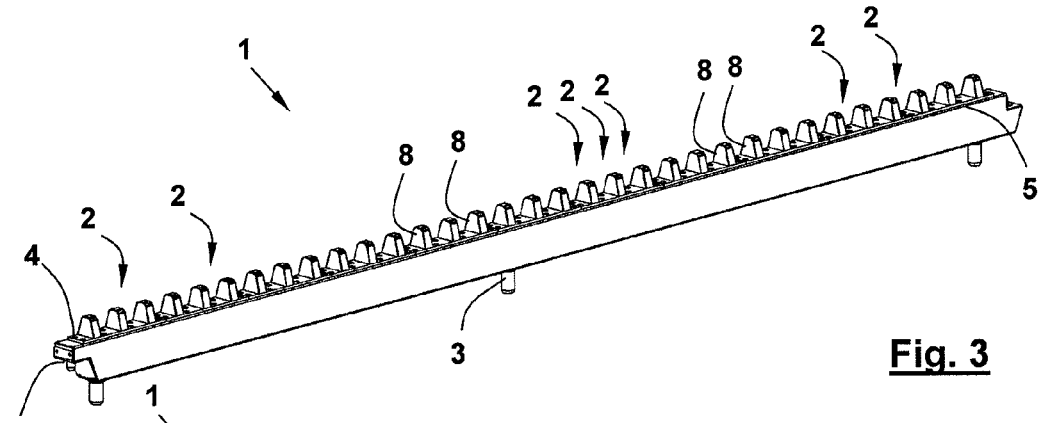
FIG. 3 and FIG. 4 are perspective and elevational views, respectively, of a second embodiment of the supporting girder according to the invention.
Figure 5:
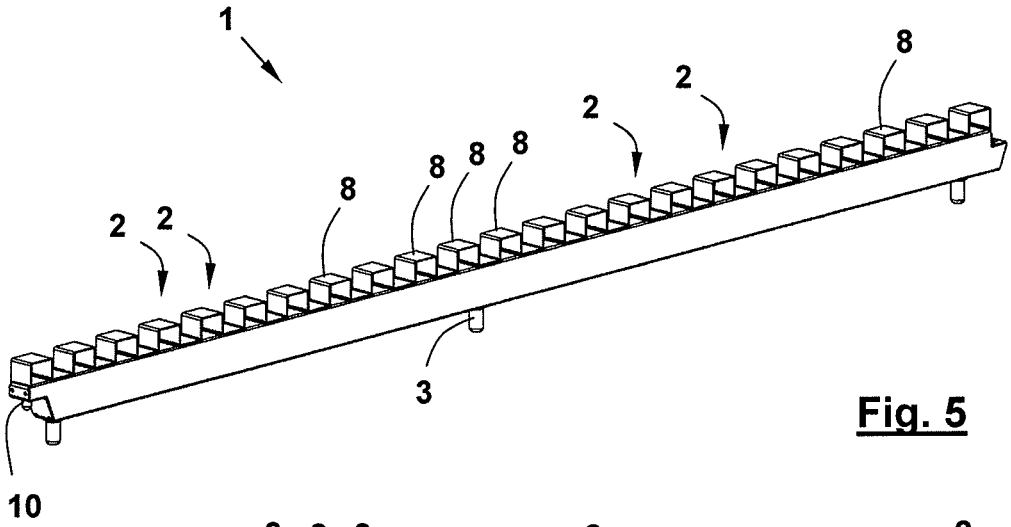
FIG. 5 and FIG. 6 are perspective and elevational views, respectively, of a third embodiment of the supporting girder according to the invention.
Figure 9:
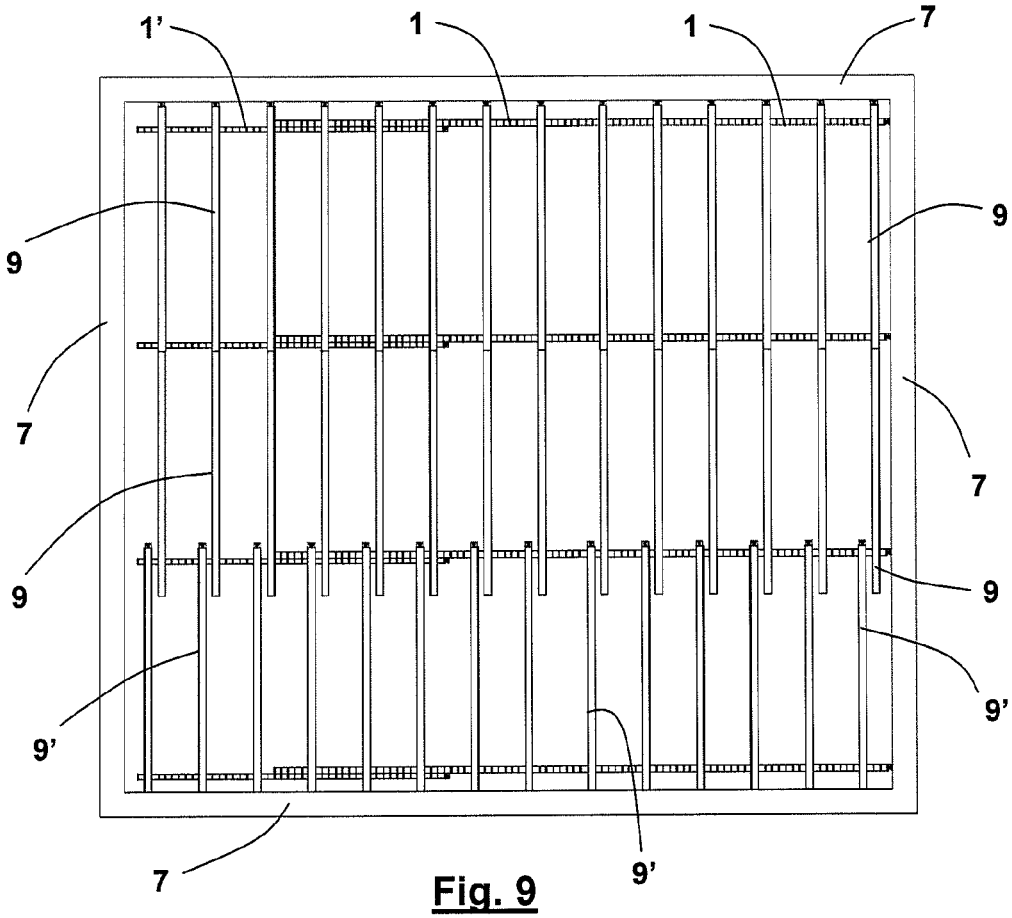
FIG. 9 is a plan view of the assembly of FIG. 7, in which the overlaps between the girders and the overlaps between the supporting girders are seen.
Figure 10:
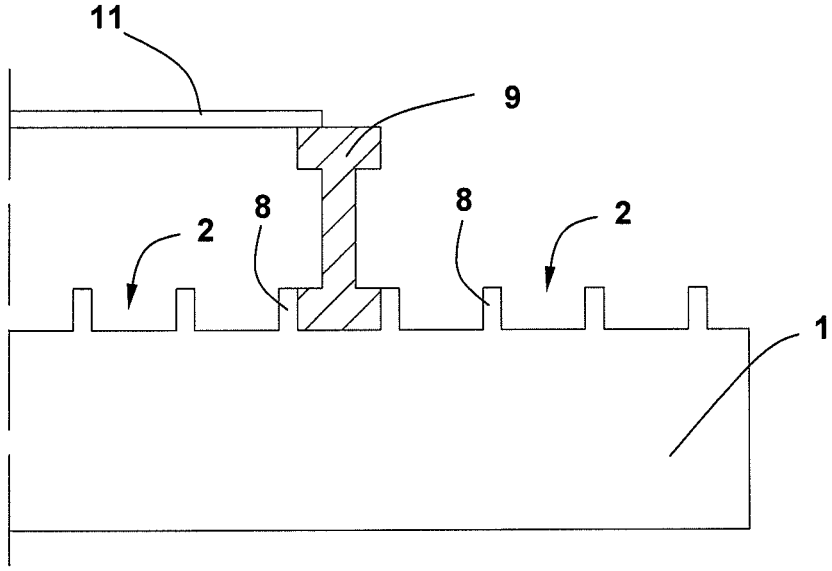
FIG. 10 is a partial view of the assembly of a wooden girder on the supporting girder of FIG. 1.

FIGS. 1, 3 and 5 show three models of supporting girders 1, of those receiving the support of girders 9 (see FIGS. 8 to 9) on which the floor slab formwork boards 11 are supported (see FIG. 10). Said supporting girders 1 are provided, on their upper face 5, with a plurality of successive housings 2, arranged one after another forming a series of housings 2 without interruption along the entire length of said face. It is precisely in said housings 2 in which the girders 9 are supported, and as a result of the existence of housings 2 distributed regularly along the entire length of each supporting girder 1, the girders 9 can be placed transversely to the supporting girder 1 and overlapped with another girder 9 which needs to be extended beyond the supporting girder 1 in which one of its ends is supported, as will be explained below.

All the housings 2 preferably have identical transverse dimensions, which allows extending the supporting girder 1 by overlapping it with another one and, at the same time, regulating the length of said extension. This, added to the fact that the housings 2 are distributed regularly along the entire length of the supporting girder 1, makes the person assembling the formwork system have the sufficient freedom to place the girders 9 in those positions which he considers most suitable, being able to change the inter-axis thereof according to the width of the boards 11, the load and the deflection of the floor slab, or adapting the placement scheme to the reconsiderations of the floor slab itself caused by the variation of the dimensions of stairwells, elevator shafts, or conduit passage gaps. Thus, as a result of the supporting girder 1 described, a formwork system which is completely modular in both directions is achieved, since it allows overlapping both girders 9 and supporting girder 1 with a precise regulation of the extension in both directions.

Figure 2:
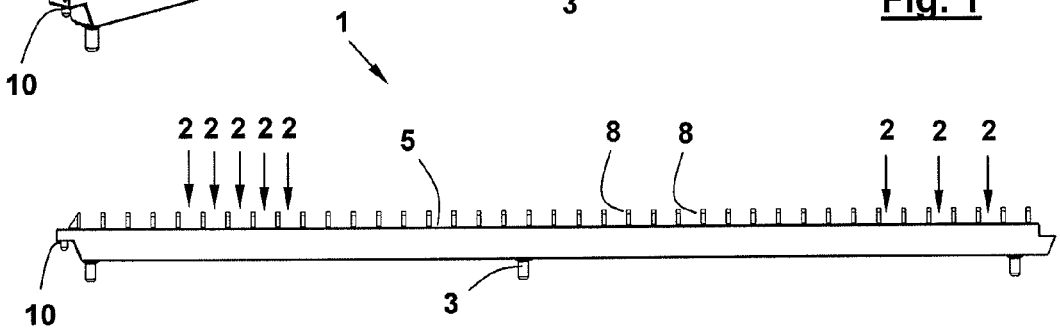

The models of the supporting girders 1 depicted in FIGS. 1, 3 and 5, each of which has three pins 3 for its coupling to respective props (not depicted), differ from one another in the configuration of the projections 8 arranged in a direction perpendicular to the upper face 5 of said supporting girders, each of the housings 2 being defined by the space between two contiguous projections 8. In the supporting girder 1 of FIGS. 1 and 2 the projections 8 are formed by small, essentially square, metal plates fixed on the upper face 5 of the supporting girder.

Figure 4:
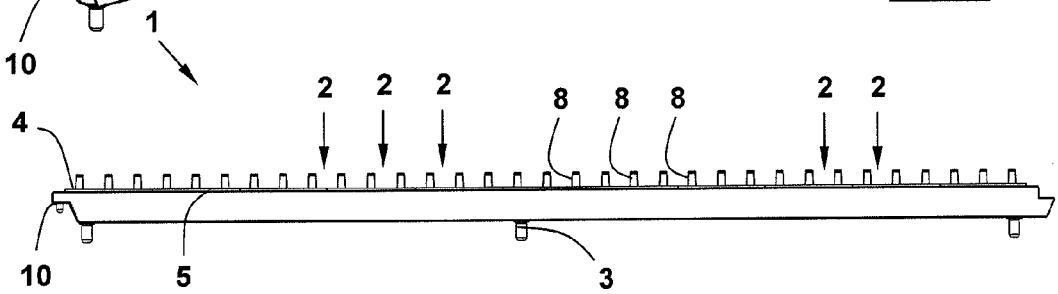

In the supporting girder 1 of FIGS. 3 and 4, there is fixedly arranged on the upper face 5 of the supporting girder 1 a continuous strip 4 provided with a succession of essentially trapezoidal projections 8, all of it molded in plastic. The manufacture of said strip 4 provided with projections 8 is economically advantageous since long strips 4 can be manufactured in a short time and can subsequently be cut to adjust them to the length of the supporting girders 1, being able to be fixed to the upper face 5 of said supporting girders 1 by means of an adhesive or mechanical attachment, with hardly any increase of weight for them.

Figure 6:
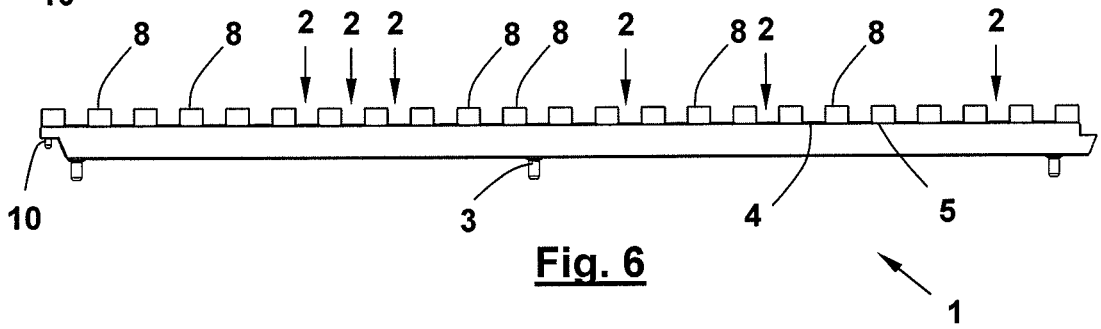

FIGS. 5 and 6 shows a supporting girder 1 the housings 2 and projections 8 of which are formed by a bent continuous metal sheet fixed to the upper face 5 of the supporting girder 1. Specifically, the separation distance between two contiguous housings 2 is equal to the transverse dimension of a housing 2. The placement of said strip 4 of bent continuous sheet allows simply and quickly obtaining a continuous succession of housings 2.

Figure 11:
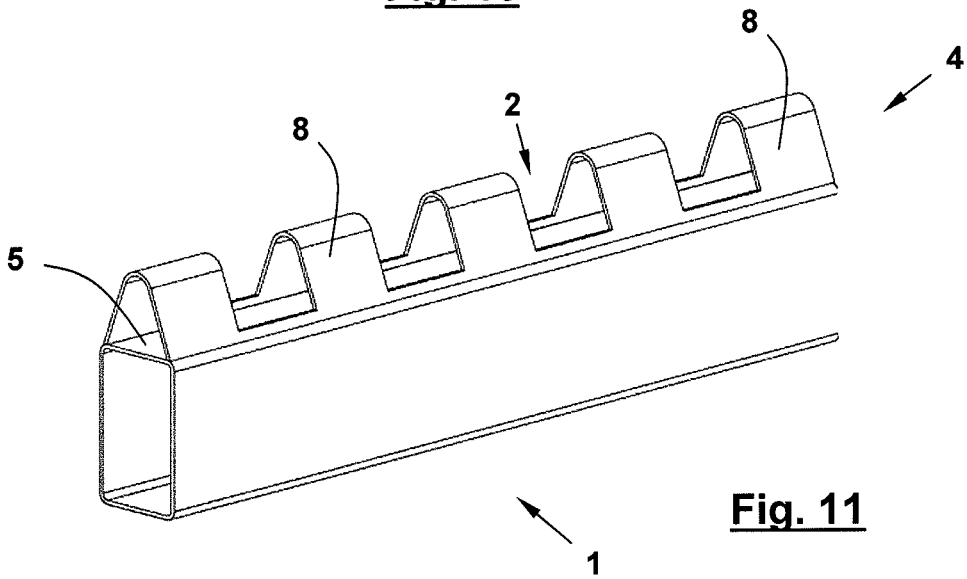
FIG. 11 is a perspective view of a part of a fourth embodiment of the supporting girder according to the invention.
Figure 12:
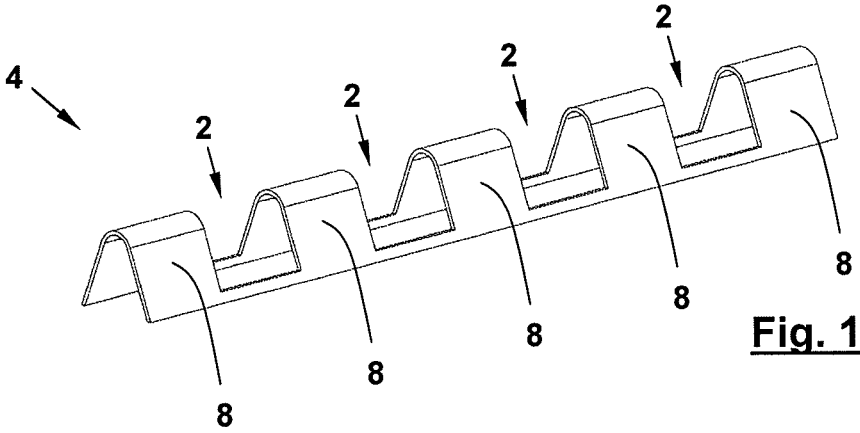
FIG. 12 is a perspective view of the continuous strip applied on the upper face of the supporting girder of FIG. 11.

FIG. 11 shows a part of another supporting girder 1 wherein the housings 2 and the projections 8 are formed by a continuous metal strip 4 provided with rectangular openings (rectangles cut out), said strip 4 having been bent afterwards (see FIG. 12) and then applied to the upper face 5 of the supporting girder 1. As can be seen, the projections 8 and the openings have the same width.

Although it has not been depicted, another option is that the projections 8 of the supporting girder 1 are removably couplable to the upper face 5 of the supporting girder 1 in question, i.e., they are detachable, such that the person assembling the formwork system decides in which section of the supporting girder 1 it is necessary to place a housing 2 for positioning a corresponding girder 9. For example, a projection 8 could be formed by a small rectangular plate, such as those of FIGS. 1 and 2, being provided with a coupling pin at its lower end, intended to tightly fit in one of the successive holes made one after another in the upper face 5 of the supporting girder 1.

As can be seen in FIGS. 1 to 6, the two longitudinal ends of the supporting girder 1 have different configurations, a male type end, provided with a small downwardly oriented pin 10, and a female type end, provided with a hole intended to house the small pin 10 of the end of another supporting girder 1, being distinguished. This type of male-female configuration is usual in the supporting girders 1 known to date and is what allows longitudinally linking a supporting girder 1 after another one.

Figure 7:
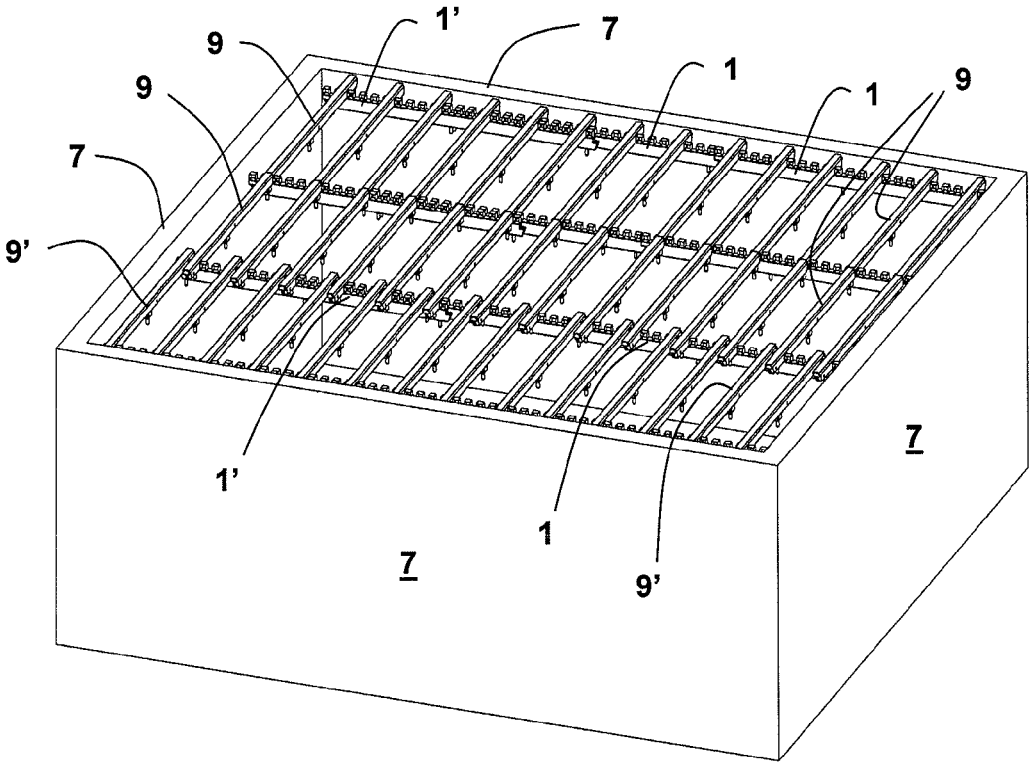
FIG. 7 is a perspective view of the assembly between four walls of a system made up of girders and supporting girders according to the invention.

FIGS. 7 and 9 show a structure formed by four concrete walls 7 delimiting a floor slab surface to be formed by means of the system of girders 9 and supporting girders 1. In this case, each supporting girder 1 receives the support of six girders 9, separated from one another by three housings 2. As can be seen, to cover the length of the floor slab between the two walls 7 (direction parallel to the supporting girders 1), it has been necessary to arrange three supporting girder 1, having to overlap two of them (left part), since the length of three supporting girder 1 placed one after another would have exceeded the length of the floor slab.

The overlap between the supporting girders 1 does not involve any difficulty because it is enough to place a second supporting girder 1' next to the supporting girder 1 to be extended, moving the second supporting girder 1' parallel to the first one until its end virtually touches the wall 7. Finally, the extension length must be slightly adjusted by moving the supporting girder 1' until the housings 2 of the first and second supporting girders 1 and 1' are transversely aligned, so that the girders 9 can be placed in the overlapped sections of the supporting girders 1. With the supporting girders 1, the entire surface to be formed is covered because, since there is a series of continuous housings 2 with identical dimensions along the entire upper face 5 of the supporting girder 1, the extension of the length of the supporting girders 1 is a multiple of the distance separating two contiguous housings 2, and therefore, the regulation of the extension can be adjusted with a high degree of precision, unlike other systems, in which the extension is conditioned by the considerable separation existing between groups of housings of the supporting girders and the position of centering rods and flanges provided with a hole for the transverse alignment of the groups of housings of two supporting girders.

Figure 8:
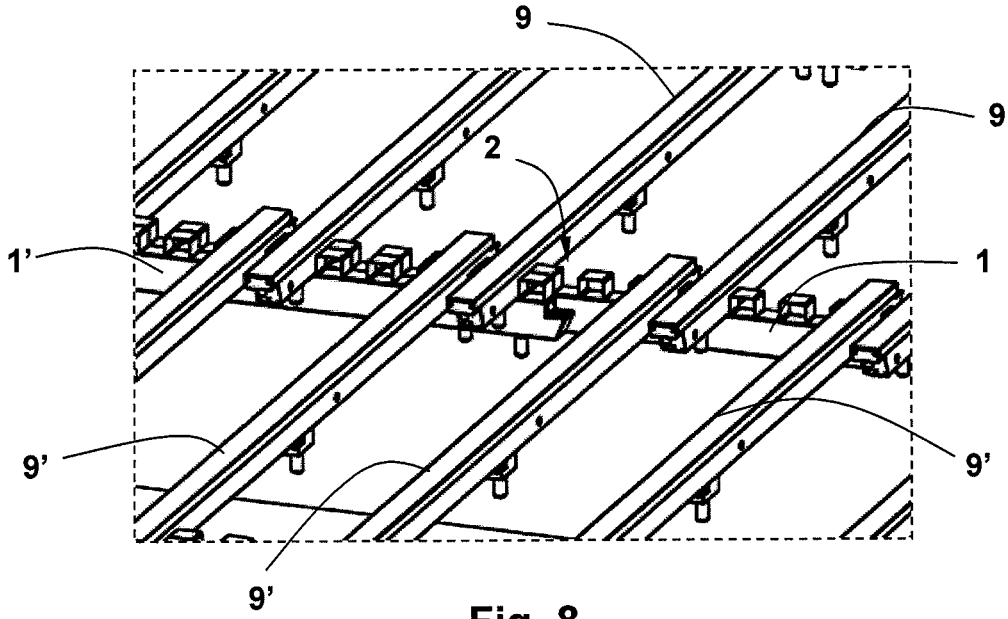
FIG. 8 is a detailed view of a section of the assembly of FIG. 7.

It is also observed in the structure of FIGS. 7 and 9 that the width of the surface to be formed (formwork surface) is greater than the equivalent of the length of two girders 9 but less than the length of three girders 9, therefore in order to cover the entire surface two girders 9, 9' have had to be longitudinally overlapped in each alignment (see the overlaps in the lower third of FIG. 9). FIG. 8 shows the overlaps of the pairs of girders 9-9', in the which the end section of a girder 9 fits in one of the housings 2 of a supporting girder 1, and in the housing 2 contiguous to the latter there is supported the end of the girder 9' serving as an extension of the former.

Once again, the succession of identical housings 2 arranged along the entire length of the supporting girders 1 allows the person assembling the formwork to space out the girders 9 depending on variable parameters in each construction work, or even in each projected floor, such as the dimensions of the formwork boards 11, the load and the deflection of the floor slab, being able to perform overlaps between girders 9, 9' in any position along a supporting girder 1, since there is no limitation for the distance between girders 9 which is marked by fixed positions of groups of housings established in the supporting girders 1.

In FIGS. 7 to 9, the girders 9, 9' are metal beams which are usually formed by rectangular profiles, generally with a width comprised between 50 and 60 mm and a height of about 80 mm.

In contrast, FIG. 10 depicts a wooden girder 9, with an I-shaped profile, with an approximate height of 200 mm as this profile is one of the most used in floor slab formworks. One of the problems linked to the use of wooden girders 9 such as the one depicted is the overturn thereof, due to their considerable height in relation to their width. In the case of metal girders 9, 9' it is virtually impossible for them to overturn even when there is a certain clearance within the housing 2 created between two contiguous projections 8 since the height of the girders 9, 9' is relatively small.

Another aspect to be emphasized is that the dimensions of the metal girders 9, 9' do not change, unlike in wooden girders 9 in which humidity or heat can make the width of the girders 9 (including that of the base) increase or shrink, respectively. Thus, the dimensions of the housings 2 must be sufficiently adjusted to the base of the wooden girders 9 to prevent the girders 9 from moving and overturning, and wide enough to allow the wooden girders 9 to fit in the housings 2 even the environment is humid.

Having detected said problem, a number of tests were conducted in extreme environmental conditions. In a dry environment, it was detected that with housings 2 that were 84 mm wide, the girders 9 still moved enough to overturn and in humid environment with housings of 81 mm the girders 9 did not fit in the housings 2. By testing housings 2 of 82 mm in average humidity conditions it was verified that the girders 9 did not overturn, although the best results in any environment were obtained with supporting girders 1 with housings 2 with a width of 83 mm.

The invention claimed is:

1. A formwork system for two-way floor slabs with main beams in both directions or for flat floor slabs, comprising:

a plurality of formwork boards defining the formwork surface of the floor slab to be concreted, a plurality of girders, each one adapted to support at least one of the formwork boards transversely arranged on a upper face of the girder, and a plurality of supporting girders each one adapted to support at least two of the plurality of girders transversely arranged on the upper face of the supporting girders, wherein at least one end of each girder extends beyond an edge of the upper face of at least one of the supporting girders, crossing a width of said at least one of the supporting girders, wherein the upper face of each of the supporting girders is provided with a plurality of successive housings for receiving the girders, said housings being arranged one after another forming a series of housings along an entire length of said upper face without interruption, such that the girders can be placed transversely and, where appropriate, overlapped with one another for their extension, in any position along the supporting girder, wherein the plurality of successive housings of the supporting girders is formed by a continuous strip provided with a succession of projections, such that the housings are defined by a space between two contiguous ones of the projections, said strip provided on the upper face of each of the supporting girders.

2. A formwork system according to claim 1, wherein the housings of the supporting girders have identical transverse dimensions.

3. A formwork system according to claim 1, wherein the girders are made of wood and a transverse dimension of the housings of the supporting girders is between 81.5 and 83.5 mm.

* * * * *